United States Patent [19]

Rutten

[11] Patent Number: 4,632,086

[45] Date of Patent: Dec. 30, 1986

[54] ROTOR FOR CENTRIFUGAL LAUNCHING DEVICE

[76] Inventor: Léon L. Rutten, 29, rue Duvivier, 4000 Liege, Belgium

[21] Appl. No.: 521,013

[22] Filed: Aug. 9, 1983

Related U.S. Application Data

[63] Continuation of Ser. No. 326,003, Nov. 30, 1981, abandoned.

[30] Foreign Application Priority Data

Apr. 12, 1980 [BE] Belgium ..... 2/58887

[51] Int. Cl.[4] ..... F41D 15/00

[52] U.S. Cl. ..... 124/6; 124/4

[58] Field of Search ..... 124/6, 4, 41 R, 83, 124/51 R, 82

[56] References Cited

U.S. PATENT DOCUMENTS

| | | | |
|---|---|---|---|
| 1,223,069 | 4/1917 | Porter | 124/6 |
| 1,235,897 | 8/1917 | Howie | 124/6 |
| 1,332,992 | 3/1920 | Moore et al. | 124/6 |
| 1,357,028 | 10/1920 | Case | 124/6 |
| 1,408,137 | 2/1922 | Parsons | 124/6 |
| 1,783,053 | 11/1930 | Baden-Powell | 124/6 |
| 2,043,117 | 6/1936 | Baden-Powell | 124/6 |
| 2,391,636 | 12/1945 | McArthur | 124/6 X |
| 2,603,203 | 7/1952 | Harold | 124/6 |
| 3,177,862 | 4/1965 | Allemann | 124/41 R X |
| 3,613,655 | 10/1971 | Tobin | 124/6 |

FOREIGN PATENT DOCUMENTS

| | | | |
|---|---|---|---|
| 380697 | 9/1923 | Fed. Rep. of Germany | 124/6 |
| 100791 | 6/1916 | United Kingdom | 124/6 |
| 437359 | 7/1934 | United Kingdom | 124/6 |

*Primary Examiner*—Richard J. Apley
*Assistant Examiner*—John Welsh
*Attorney, Agent, or Firm*—Bacon & Thomas

[57] ABSTRACT

A rotor for a centrifugal launching device supported for rotation about an axis and including a cylindrical barrel. The axis of rotation and longitudinal axis of the barrel define two straight lines skewed with respect to each other to permit the launching of projectiles having an oblong configuration.

2 Claims, 2 Drawing Figures

ROTOR FOR CENTRIFUGAL LAUNCHING DEVICE

This application is a continuation of application Ser. No. 326,003 filed Nov. 30, 1981.

BACKGROUND OF THE INVENTION

1. Field of the Invention

The present invention relates to a rotor for centrifugal launching device.

2. Description of the Prior Art

A centrifugal launching device within the scope of the present invention comprising a rotating part or rotor driven at great speed around an axis of rotation and equipped with means for successively bringing projectiles into the central zone of the rotor for ejection therefrom radially by centrifugal force.

All launching devices of this type known to applicant use substantially spherical projectiles or, much less often, projectiles in the shape of discs. There are difficulties which are inherent in the feeding of the launching device, a procedure requiring perfect control of each projectile, both in time and space, at the moment at which it is being abandoned to the rotor. It is this reason why spherical projectiles have been preferred, for they have no preferential axis.

Spherical projectiles, however, have considerable limitations in the military field, including limitations of ejection speed, ballistic characteristics which are unfavorable, practical impossibility of receiving explosive charges, and other disadvantages.

SUMMARY OF THE INVENTION

The object of the invention is to provide for a rotor capable of launching in good condition, oblong projectiles, the shape of which is closely related to the shape of the conventional shells, the latter defined by a tail end, a body and a conical point.

For this purpose, a rotor according to the invention and of the type provided with a cylindrical gun rotating around an axis, is characterized in that the geometrical axis of rotation of the rotor and the longitudinal axis of the gun are two skew straight lines. The gun is boxed in between two cheeks mounted at the end of a drive shaft, with the cheeks having a free central space into which one end of the gun is located adjacent to the axis of rotation.

This end of the gun is extended by a picking up blade.

This arrangement permits the picking up blade to tangientially pick up each projectile that is correctly presented for this purpose adjacent to the aforesaid axis of rotation.

The means for presenting the projectile to the gun is not a part of the invention. By cylindrical gun, within the scope of the present invention, is construed to mean a tubular or semi-tubular gun, the axis of which is rectilinear or has only a slight bend or bends.

BRIEF DESCRIPTION OF THE DRAWINGS

For more clearness, an embodiment of the invention is described hereinafter as illustrative and not restrictive, reference being made to the annexed drawings, in which.

Figure 1:
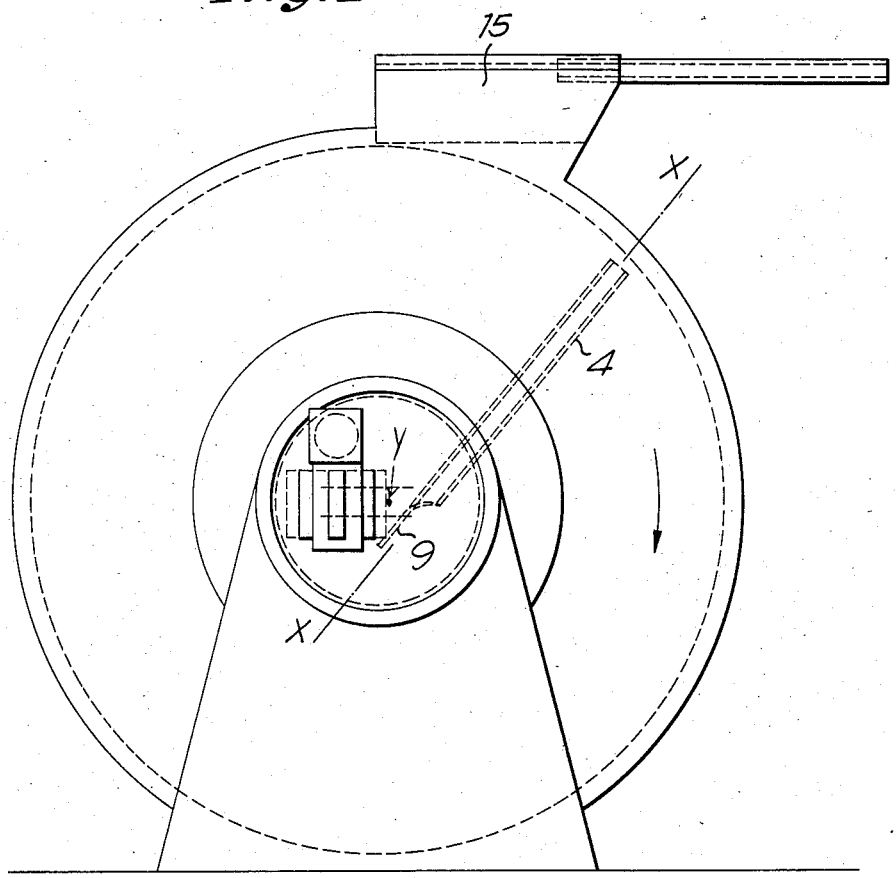
FIG. 1 is a front view of a launching device according to the invention.

The launching device which is shown comprises a rotor 1 defined by two cheeks 2 and 3 bolted together and enclosing a cylindrical gun 4. This assembly is mounted at the end of a shaft 5 carried by rolling bearings supported by a frame-work 6. This shaft 5 can be driven by a motor, which is not shown.

The cheeks 2 and 3 are each provided with a central bore, which leaves a free space 7 at the center of the rotor. In this space is disposed the end of a feeding and presenting device, schematically shown at 8.

Figure 2:
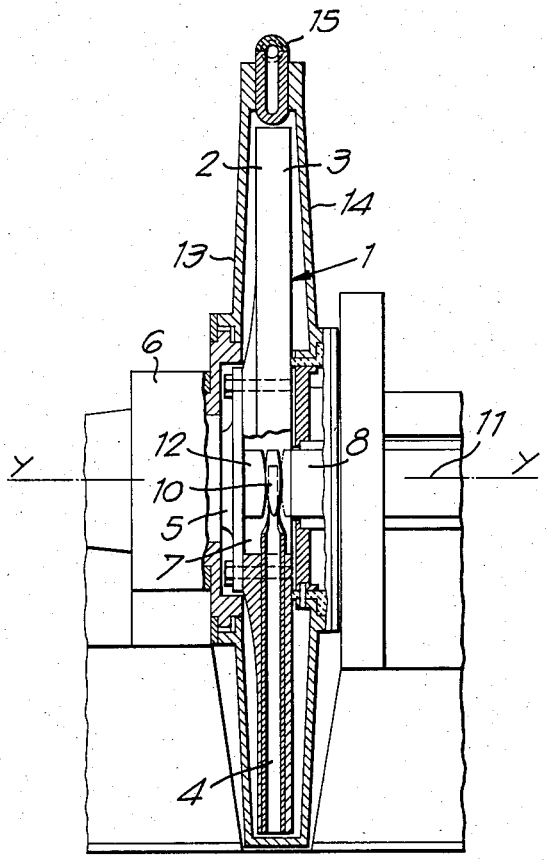
FIG. 2 is an axial section.

The gun 4 is arranged between the cheeks 2 and 3 in such a way that its longitudinal axis X—X and the axis of rotation Y—Y of the rotor are two skew straight lines. In this example, the projections of these straight lines in the plane of FIG. 2 are furthermore perpendicular to each other.

The gun 4 has such a length that one end of which is located adjacent to the axis Y—Y within space 7. This end is provided with a picking up blade 9 which is an extension of a part of the wall of the gun 4, the width of which is slightly less than the calibre of the projectiles 10. The length of the aforesaid blade is slightly greater than the distance existing between the centre of gravity of a projectile 10 and tip of its conical point.

The device 8 comprises a charger 11 in which the projectiles 10 are aligned side by side and pushed against a stop 12. A projectile which is applied against the stop 12 is immediately taken over by the blade 9 which, in its rotation, picks up the projectile tangentially and removes it from between the stop 12 and the next projectile. As indicated in FIG. 1, the rotor rotates in a clockwise direction and, in its rotation, the blade 9 comes and places itself between the axis of rotation Y—Y and projectile in order to pick up the latter.

The rotor is surrounded by two protective cheeks 13 and 14 carrying a correction device 15, the latter being necessary for bringing the axis of the projectile on the trajectory of its centre of gravity at the time of the ejection. This correction device forms no part of the present invention.

In the example described hereinabove, the gun is preferably a cylindrical steel tube. It may, however, be replaced by a semi-cylindrical blading, without departing from the scope of the present invention.

In the case wherein the gun should have slight bends, it would be the tangent to the end of the gun located next to the axis of rotation and the latter which would form two skew straight lines.

It is clear that the rotor is provided with equilibrating masses, which, for the sake of clearness, are not shown. A rotor according to the invention, with a diameter of 950 mm, rotating at a speed of 12,433 rev/min permits launching a projectile at an ejection speed of 800 m/sec.

What I claim is:

1. A rotor for a centrifugal launching device for launching projectiles, wherein the rotor is supported for rotation about an axis, the rotor comprising:

(a) a pair of circular cheeks defining a central space therebetween;

(b) a straight cylindrical gun barrel having a longitudinal axis in and being supported between and connected to the cheeks, the barrel having one end disposed within the central space and positioned adjacent the axis of rotation of the rotor, the one end including means for receiving and launching oblong projectiles through the barrel, the means for receiving the projectiles including a blade which tangentially engages each projectile as it is loaded from a direction defined by a second axis that is disposed perpendicular to the axis of rotation; and (c) the axis of rotation of the rotor and the longitudinal axis of the gun barrel being geometrically disposed as two straight nonintersecting skew lines in a first plane and perpendicular to each other in a second plane.

2. The rotor of claim 1 for launching projectiles, each of which is of a substantially oblong configuration defined by a tail end, a body and a conical point, wherein the width of the blade is less than the width of a projectile, and the length of the blade is greater than the distance between the center of gravity of the projectile and the tip of the conical point.

* * * * *